US007172363B2

(12) United States Patent
Olson et al.

(10) Patent No.: US 7,172,363 B2
(45) Date of Patent: Feb. 6, 2007

(54) PAVING MACHINE OUTPUT MONITORING SYSTEM

(75) Inventors: Dale M. Olson, Hamel, MN (US); Mario J. Souraty, Plymouth, MN (US)

(73) Assignee: Caterpillar Paving Products Inc, Minneapolis, MN (US)

( * ) Notice: Subject to any disclaimer, the term of this patent is extended or adjusted under 35 U.S.C. 154(b) by 0 days.

(21) Appl. No.: 10/929,469

(22) Filed: Aug. 31, 2004

(65) Prior Publication Data

US 2006/0045620 A1 Mar. 2, 2006

(51) Int. Cl.
*E01C 23/07* (2006.01)

(52) U.S. Cl. ..... 404/75; 404/84.1; 404/118

(58) Field of Classification Search ..... 404/84.05, 404/84.1, 84.2, 84.5, 84.8, 72, 75, 96, 118; 33/1 H; 356/63; 181/124
See application file for complete search history.

(56) References Cited

U.S. PATENT DOCUMENTS

| | | | | | |
|---|---|---|---|---|---|
| 3,967,912 | A | | 7/1976 | Parker | 404/84 |
| 4,012,160 | A | | 3/1977 | Parker | 404/84 |
| 4,918,608 | A | | 4/1990 | Middleton et al. | 364/424.07 |
| 4,933,853 | A | | 6/1990 | Musil et al. | 364/424.07 |
| 4,943,119 | A | | 7/1990 | Zarniko et al. | 299/1 |
| 5,201,604 | A | | 4/1993 | Ferguson et al. | 404/110 |
| 5,258,961 | A | * | 11/1993 | Sehr et al. | 367/96 |
| 5,356,238 | A | * | 10/1994 | Musil et al. | 404/84.1 |
| 5,362,176 | A | | 11/1994 | Sovik | 404/72 |
| 5,393,167 | A | | 2/1995 | Fujita et al. | 404/84.1 |
| 5,401,115 | A | | 3/1995 | Musil et al. | 404/72 |
| 5,549,412 | A | * | 8/1996 | Malone | 404/84.1 |
| 5,556,226 | A | * | 9/1996 | Hohmann, Jr. | 404/84.1 |
| 5,588,776 | A | | 12/1996 | Swisher, Jr. et al. | 404/72 |
| 5,752,783 | A | * | 5/1998 | Malone | 404/84.2 |
| 6,152,238 | A | | 11/2000 | Ferrell et al. | 172/2 |
| 6,161,986 | A | | 12/2000 | Smith et al. | 404/75 |
| 6,227,761 | B1 | * | 5/2001 | Kieranen et al. | 404/84.5 |
| 6,238,135 | B1 | * | 5/2001 | Rower | 404/84.5 |
| 6,352,386 | B2 | * | 3/2002 | Heims | 404/84.5 |
| 6,364,028 | B1 | | 4/2002 | Ferrell et al. | 172/1 |
| 6,749,364 | B1 | * | 6/2004 | Baker et al. | 404/84.5 |
| 6,916,070 | B2 | * | 7/2005 | Sehr | 299/1.5 |

FOREIGN PATENT DOCUMENTS

| | | | |
|---|---|---|---|
| DE | 4040029 C | * | 4/1992 |
| EP | 542297 A1 | * | 5/1993 |
| WO | WO 00/70150 | | 11/2000 |

* cited by examiner

*Primary Examiner*—Gary S. Hartmann
(74) *Attorney, Agent, or Firm*—Finnegan, Henderson, Farabow, Garrett & Dunner

(57) ABSTRACT

A paving machine may include a power source, a traction system, a hopper configured to contain paving material, and one or more conveyors configured to transfer the paving material from the hopper. The paving machine may also include a screed configured to lay a mat of the paving material. The paving machine may further include at least one front sensor mounted on a front portion of the paving machine and configured to measure height from a surface to the front sensor and at least one rear sensor mounted on the paving machine and configured to measure height from a surface of the mat to the rear sensor. The paving machine may also include a controller configured to determine a thickness of the mat by determining a difference between one or more front height measurements taken by the at least one front sensor and one or more rear height measurements taken by the at least one rear sensor.

29 Claims, 4 Drawing Sheets

PAVING MACHINE OUTPUT MONITORING SYSTEM

TECHNICAL FIELD

This disclosure relates to a system and method for monitoring the output of a paving machine and, more particularly, to a system and method for monitoring the thickness and smoothness of a mat of paving material, as well as automatically controlling paving machine functions.

BACKGROUND

When building roadways, for example, paving machines may be used to deposit significant amounts of paving material. Because paving material can be expensive, and because the quantities used can be so large, applying pavement with a thickness that deviates from a desired thickness can have costly consequences. If the pavement is applied in a mat that is too thick, the paving company may run out of material before the paving is complete and be forced to purchase additional material. If the mat is too thin, the pavement could perform poorly and contribute to premature failure requiring costly repairs.

Mat smoothness is another factor important to the performance of pavement. For example, if a paved roadway has a bumpy surface, increased forces will be applied to the raised bumps when the tires of vehicles drive over them. In addition to the poor ride quality experienced by passengers and cargo, the increased forces on the bumps can lead to premature failure of the pavement. Thus, providing a mat with proper and uniform thickness does not, by itself, necessarily make for pavement that performs well. For example, if the pavement is laid in a mat of uniform thickness, on top of an uneven subsurface, the mat smoothness will be poor as the mat will have the same unevenness as the subsurface.

In addition to thickness and smoothness, the density of pavement can play an important role in the performance of pavement. In order to produce pavement with uniform density, the pavement should be uniformly compacted. In order to uniformly compact pavement, its temperature should be consistent because pavement with higher temperatures will compact more than pavement with lower temperatures. Therefore, uniformity of pavement density is dependent on the uniformity of the pavement temperature as it is being applied to a surface.

Systems have been developed that attempt to control the output of paving machines. For example, U.S. Pat. No. 5,393,167 issued on Feb. 28, 1995 to Fujita et al. (the '167 patent), teaches a paving machine having height sensors along the side of the machine for measuring the height of the paving apparatus with respect to the pre-existing surface on which the pavement is being laid. However, the '167 patent does not measure the height of the sensors with respect to the actual mat that has been laid. Therefore, the '167 patent estimates or approximates mat thickness based on the measured height of the paving apparatus, rather than measurements of the mat itself. Also, the '167 patent does not monitor the smoothness of the mat. Further, the '167 patent does not monitor the temperature of the mat.

The disclosed control system relates to overcoming one or more of the problems set forth above.

SUMMARY OF THE INVENTION

In one aspect, the present disclosure relates to a paving machine. The paving machine may include a power source, a traction system, a hopper configured to contain paving material, and one or more conveyors configured to transfer the paving material from the hopper. The paving machine may also include a screed configured to lay a mat of the paving material. The paving machine may further include at least one front sensor mounted on a front portion of the paving machine and configured to measure height from a surface to the front sensor and at least one rear sensor mounted on the paving machine and configured to measure height from a surface of the mat to the rear sensor. The paving machine may also include a controller configured to determine a thickness of the mat by determining a difference between one or more front height measurements taken by the at least one front sensor and one or more rear height measurements taken by the at least one rear sensor.

In another aspect, the present disclosure relates to a method for determining a thickness of a mat of paving material. The method may include taking one or more front height measurements from a surface adjacent to a front portion of a paving machine and taking one or more rear height measurements from a surface adjacent to a rear portion of the paving machine. A difference between the one or more front height measurements and the one or more rear height measurements may be determined.

DETAILED DESCRIPTION

Figure 1:
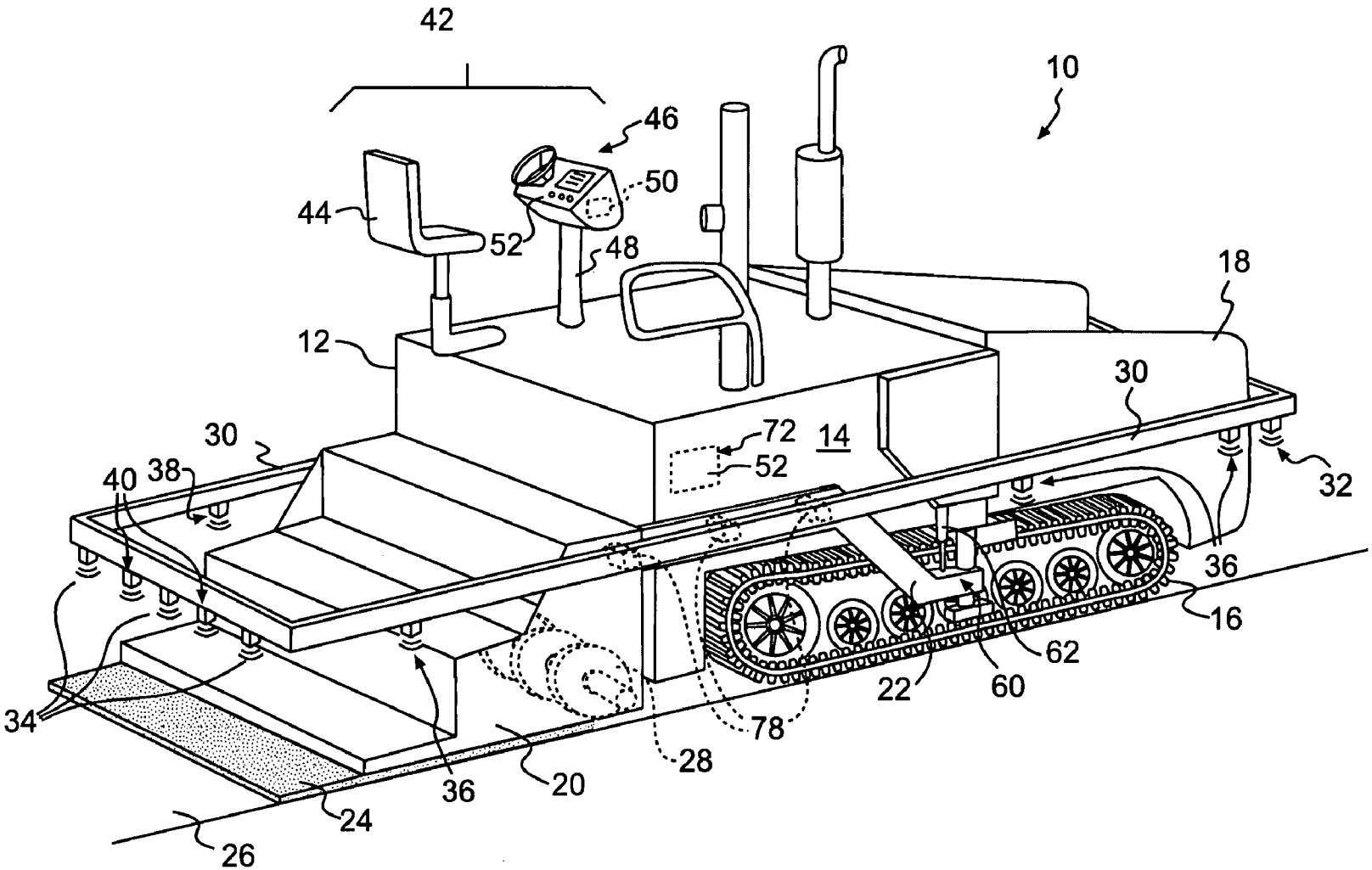
FIG. 1 is a perspective diagrammatic view illustration of a paving machine according to an exemplary disclosed embodiment.

FIG. 1 is an illustration of a paving machine 10. Although paving machine 10 is depicted in the figures as an asphalt paver, the presently disclosed control system may be used on any kind of paving machine for any kind of paving material. Exemplary paving materials for which the disclosed control system may be used include asphalt, concrete, and loose aggregate materials such as crushed gravel.

Paving machine 10 may include a tractor 12 having a power source 14, one or more traction devices 16, and a hopper 18 for containing paving material. Paving machine 10 may also include a screed 20 attached to tractor 12 by tow arms 22 and towed behind tractor 12 to spread and compact paving material into a mat 24 on a paving surface 26. Screed 20 may include one or more augers 28 for spreading paving material. In addition, paving machine 10 may include a sensor frame 30 attached to screed 20 and/or to tow arms 22. Sensor frame 30 may include one or more front height sensors 32, one or more rear height sensors 34, a set of right side height sensors 36, a set of left side height sensors 38, and one or more rear temperature sensors 40.

Paving machine 10 may also include an operator station 42. Operator station 42 may include a seat 44 and a console 46, which may be mounted on a pedestal 48. Operator station 42 may include a controller 50, as well as a user interface 52 for accepting user input and displaying information to a user.

Although traction devices 16 are shown in the figures as tracks, traction devices 16 could alternatively be wheels or any other type of traction devices. Traction devices 16 could also be combinations of different types of traction devices. For example, paving machine 10 could include both tracks and wheels.

Figure 2:
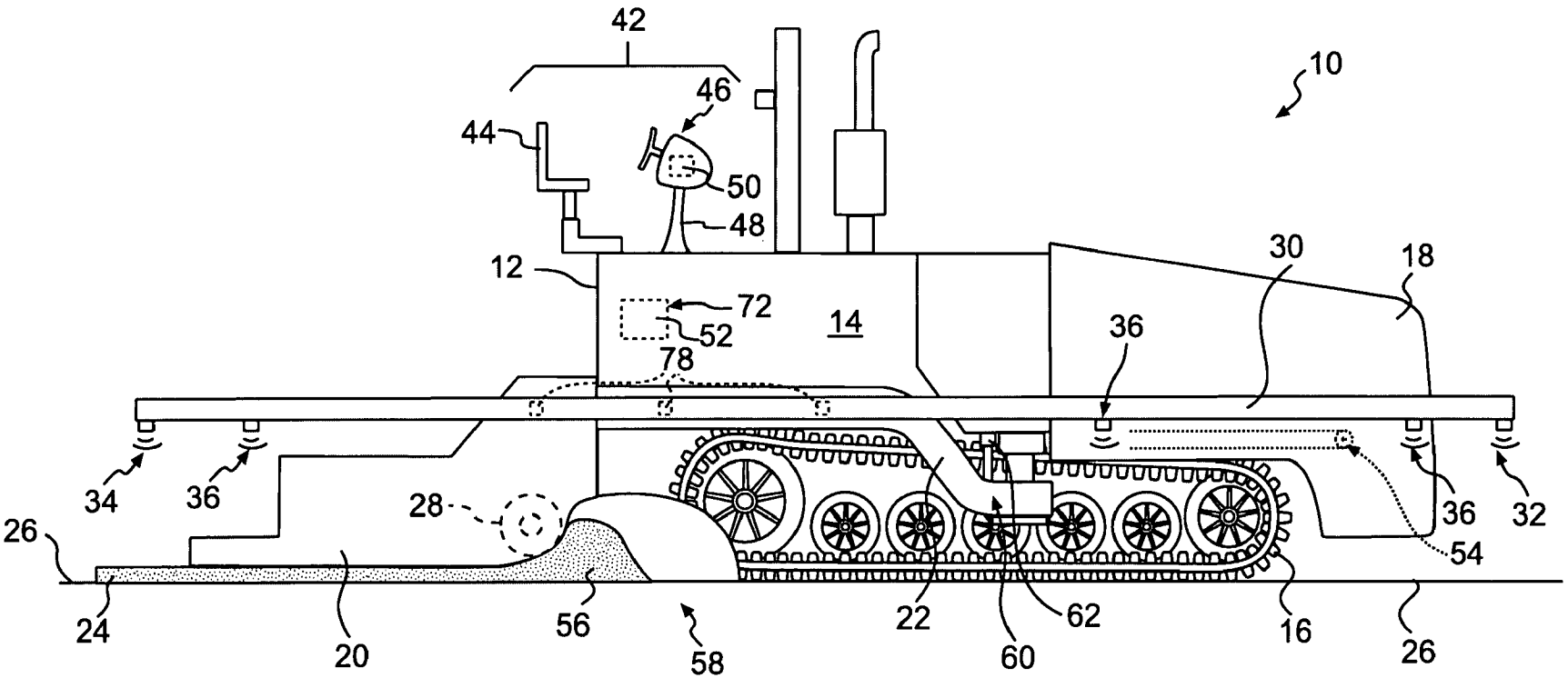
FIG. 2 is a side diagrammatic view illustration of a paving machine according to an exemplary disclosed embodiment.

Referring now to FIG. 2, paving machine 10 may include hopper 18 for containing paving material. Paving material may be dumped into hopper 18 from trucks that deliver the paving material to a work site. Paving machine 10 may include one or more conveyors 54 at the bottom of hopper 18. Conveyors 54 may be positioned side-by-side and run parallel to one another back to the rear of tractor 12. Conveyors 54 may transport paving material from hopper 18 to the rear of tractor 12 where it may be dropped behind tractor 12 in front of screed 20 onto paving surface 26 into a pile 56 (shown in a cut away portion 58 of FIG. 2). As paving machine 10 travels forward, pile 56 may be evenly spread and compacted by screed 20.

The speed of conveyors 54 may be variable to make pile 56 higher or lower. The pile height may be increased or decreased by varying the conveyor speed relative to the speed at which paving machine 10 is traveling. For example, if the conveyor speed is high, relative to the paving machine speed, then paving material may accumulate behind tractor 12 in front of screed 20, thus resulting in a higher pile. If the conveyor speed is low, relative to the paving machine speed, then the paving material may be spread over a longer stretch of paving surface 26, resulting in a lower pile.

The speed of each conveyor may be independently variable. Independently varying the speed of conveyors 54 may enable an increase or decrease in the pile height toward one side of paving machine 10 or the other. This feature may be used to even out an inadvertently lopsided pile or to purposely create a lopsided pile.

Screed 20 may spread pile 56 evenly and compact the paving material into mat 24 on paving surface 26. Screed 20 is shown in the figures as a floating type screed. However, screed 20 may be any type of screed for any type of paving material. Screed 20 may be attached to tractor 12 at tow points 60 by tow arms 22. The height of screed 20 may be adjusted by raising and/or lowering tow arms 22 at tow points 60 with screed height actuators 62. Screed height actuators 62 may be any suitable actuators, such as, for example, hydraulic cylinders. When paving machine 10 is in motion, screed 20 may float on a layer of paving material at a substantially consistent height relative to the height of tow arms 22 at tow points 60.

Screed 20 may include augers 28 for spreading pile 56 evenly beneath screed 20. Although the figures show only one of augers 28, paving machine 10 may have a single auger or any number of augers. In an exemplary embodiment, paving machine 10 may include two augers 28, which may be aligned end-to-end, and situated crossways within screed 20.

Each auger 28 may be independently controlled in order to control the output of paving machine 10. Differing auger settings may be used to compensate for imbalances in the delivery of paving material to the screed or even to create desired imbalances in the output of paving machine 10.

The speed of each auger 28 may be independently variable. For example, if more paving material is being transported by one conveyor than another, pile 56 will be higher toward one side of the machine. Increasing the auger speed on the side of paving machine 10 with the higher pile may correct for the lopsided pile height by spreading the paving material evenly.

The height of augers 28 may also be adjusted. Auger height may be adjusted in order to position augers 28 at the proper height so as to sufficiently spread pile 56. After spreading the paving material, screed 20 may smooth and compact the paving material into mat 24. If augers 28 are too high, pile 56 may not be sufficiently spread and screed 20 may not be able to smooth it out completely. If augers 28 are too low, they may disrupt the paving material such that there may not be enough material for screed 20 to smooth and compact for the height at which screed 20 may be set. After pile 56 has been spread evenly, screed 20 may smooth and compact the pavement into mat 24. After screed 20 has laid mat 24, a roller machine, separate from paving machine 10, may be used to provide additional compaction of mat 24.

Paving machine 10 may include sensor frame 30 rigidly attached to screed 20 and/or tow arms 22. Sensor frame 30 may be maintained level or at a fixed angle with respect to screed 20. Sensor frame 30 may include means for taking height measurements, such as, for example, height sensors for measuring the distance (i.e., height) from the ground to each sensor. Sensor frame 30 may also include temperature sensors for measuring the temperature of mat 24. Sensor frame 30 may include front height sensors 32, rear height sensors 34, right side height sensors 36, left side height sensors 38, and rear temperature sensors 40. The height sensors may be any kind of sensor capable of determining a distance to a surface. In an exemplary embodiment, the height sensors may be non-contacting distance sensors such as, for example, laser sensors or sonic sensors.

Figure 3:
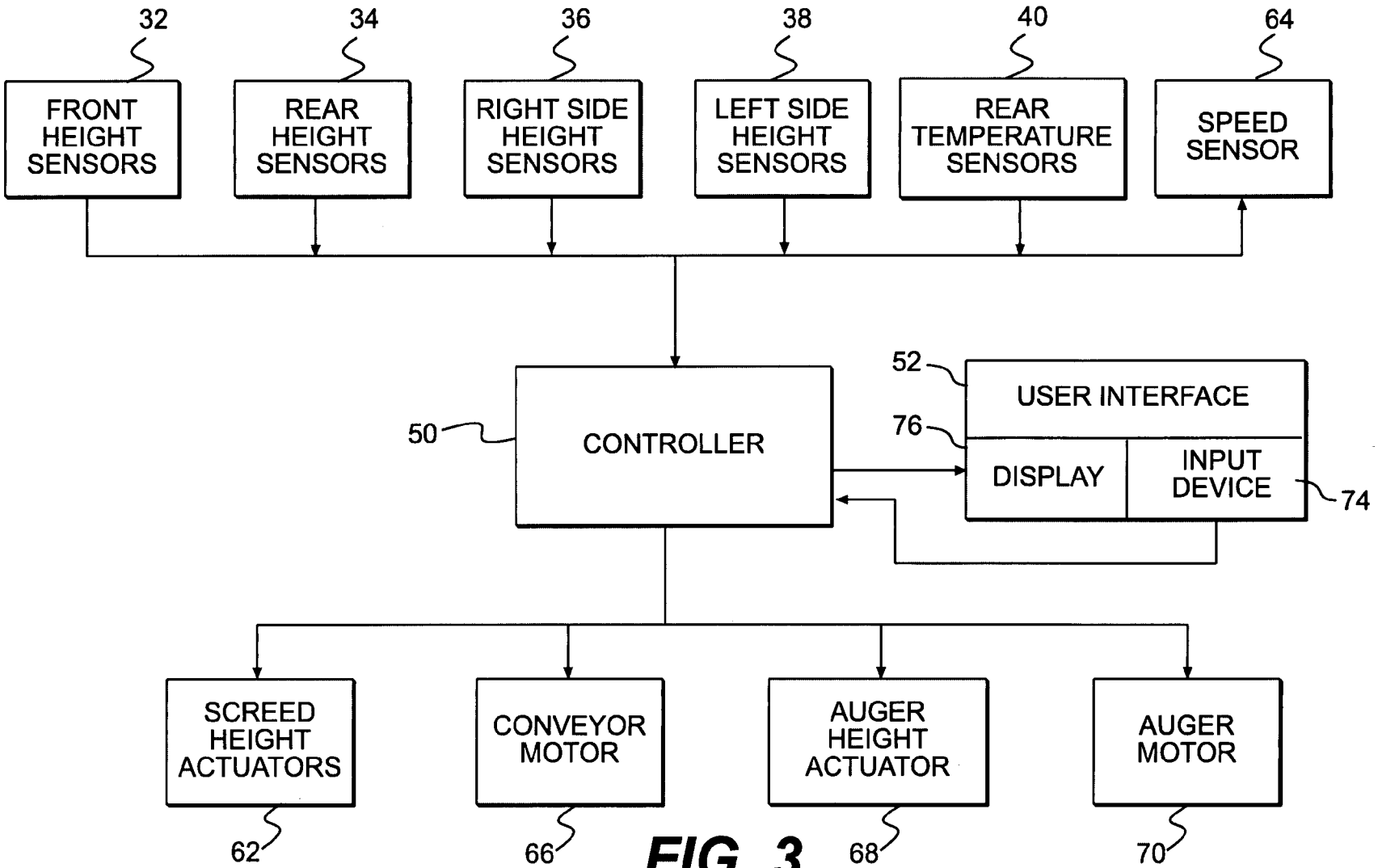
FIG. 3 is a block diagram representation of a paving machine control system according to an exemplary disclosed embodiment.

FIG. 3 depicts a block diagram representing components of the presently disclosed control system, including front height sensors 32, rear height sensors 34, right side height sensors 36, left side height sensors 38, as well as rear temperature sensors 40 and a paving machine speed sensor 64. The control system may also include controller 50, a user interface 52, and paving function components controlled by controller 50 such as, for example, screed height actuators 62, conveyor motors 66, an auger height actuator 68, and auger motors 70.

User interface 52 may be located at any suitable location on paving machine 10. User interface 52 may be located at operator station 42 where it may be incorporated into console 46 on pedestal 48. Alternatively, user interface 52 may be located at a lower position 72 (see FIG. 1) so as to be accessible to users who may be standing on the ground.

User interface 52 may include an input device 74 for changing settings of paving machine 10. Input device 74 may be any type of input apparatus including keypads, touchscreens, dials, knobs, wheels, etc. Input device 74 may include more than one input apparatus such as, for example, a series of knobs. Input device 74 may be linked to controller 50 for changing settings of paving machine 10. Such settings may include paving machine speed, conveyor speed, auger speed, screed height, auger height and any other setting desired to be changed. An operator may choose each setting from a predetermined range of values.

In addition, some settings may be linked to one another. For example, conveyor speed and auger speed may be linked such that the ratio between the two speeds remains the same (e.g., conveyor speed may always be one half of auger speed). This ratio may also be adjusted by an operator. Screed height and auger height may also be linked to one another in the same manner.

These settings may be directly linked to input device 74. For example, user interface 52 may include a dial type input apparatus specifically for adjusting the setting for conveyor speed. Alternatively, or in addition, these settings may be indirectly linked to input device 74. For example, user interface 52 may include an input dial specifically for setting a desired output of a paving machine function, such as pile height. By selecting a particular pile height, conveyor speed could automatically be set to a value that, given the current paving machine speed, would produce the desired pile height.

User interface 52 may also include a display 76. Display 76 may be any kind of display suitable for showing information to a user of paving machine 10. For example, display 76 may be a screen type monitor such as a cathode ray tube (CRT), liquid crystal display (LCD), plasma screen, or a touchscreen as discussed in connection with input device 74 above. Display 76 could also include one or more simple digital number displays. Display 76 could also include one or more analog gauges.

Paving machine 10 may include a means for recording height measurements, averaging height measurements, determining thickness and/or smoothness of a mat, as well as yield of the paving machine. Such means may be a controller, such as controller 50. Controller 50 may receive information from front height sensors 32, rear height sensors 34, right side height sensors 36, left side height sensors 38, rear temperature sensors 40, paving machine speed sensor 64, input device 74, and any other source of information to be processed or displayed. Controller 50 may send signals to display 76 for displaying settings, as well as information recorded from the sensors on paving machine 10 listed above. Controller 50 may also send signals to paving function components to control settings of these components.

Controller 50 may be configured to determine paving output data such as, for example, mat thickness, mat smoothness, mat temperature, mat elevation, and mat cross-slope from information it receives. Controller 50 may also be configured to control paving function components of paving machine 10 based on this determined data. These components may include, for example, screed height actuators 62, conveyor motors 66, auger height actuator 68, and auger motors 70.

Figure 4:
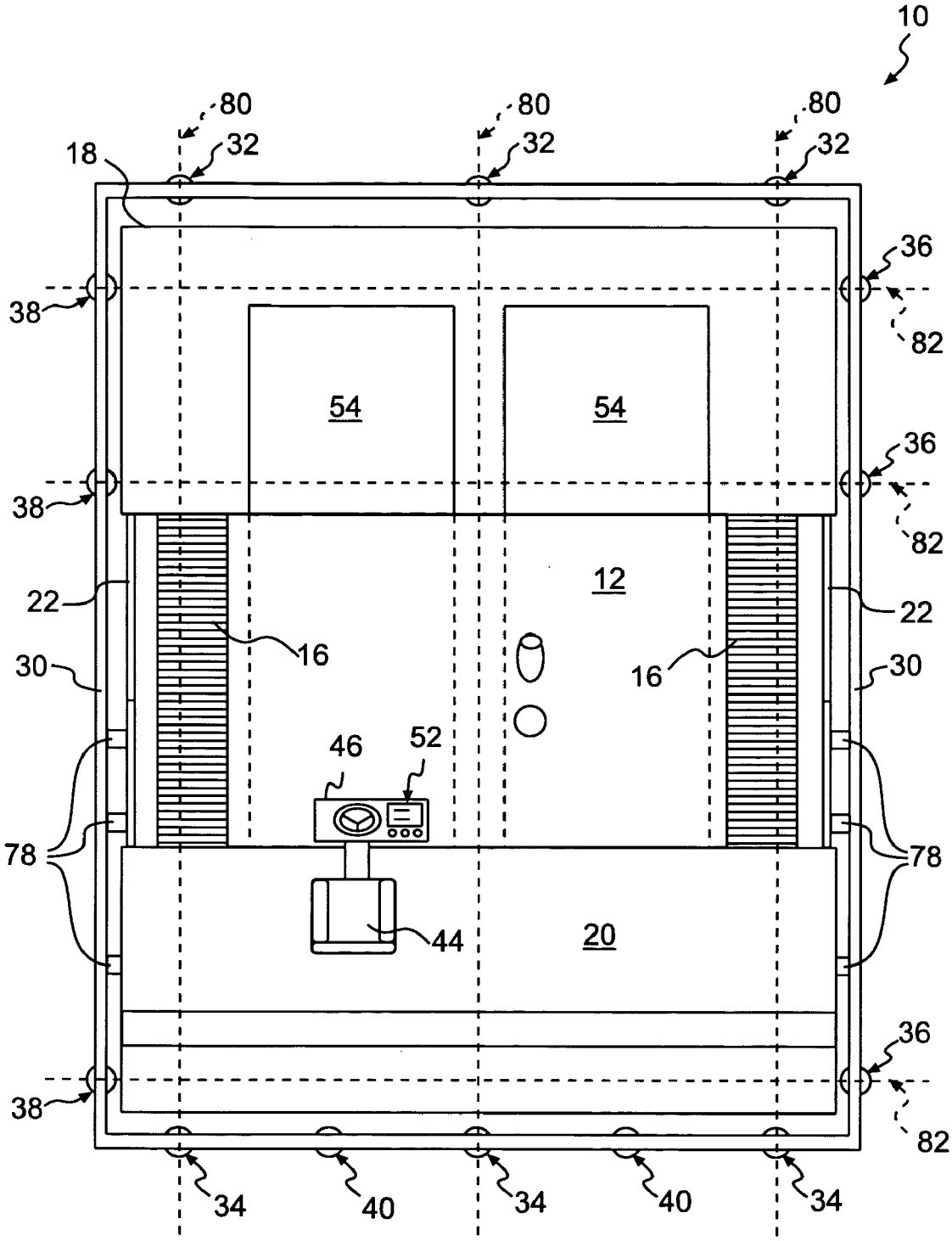
FIG. 4 is a diagrammatic top view representation of a paving machine according to an exemplary disclosed embodiment.

FIG. 4 provides a top view representation of paving machine 10. FIG. 4 shows conveyors 54 in hopper 18. FIG. 4 also shows support members 78 attaching sensor frame 30 to screed 20 and tow arms 22.

INDUSTRIAL APPLICABILITY

The disclosed control system may be used to monitor and/or control output of paving machines. Monitoring of paving machine output may improve accuracy and performance of paved surfaces, as well as reduce unnecessary costs. Automatically controlling paving machine functions may also improve accuracy and performance of paved surfaces and, additionally, may improve efficiency while enabling operators with less experience and/or a lower skill level to achieve high quality results. These advantages of the disclosed control system may be realized with any type of paving machine for any kind of paving materials.

The amount of paving material required for a particular job is determined beforehand by multiplying the desired thickness of pavement by the area of land designated to be paved, thus calculating a volume of material. The volume is converted to a weight by multiplying the known density of the particular desired paving material by the calculated volume.

The amount of material, or "yield," of a paving machine may be quantified in a similar manner. Yield may be expressed as a weight and may be calculated by multiplying the thickness of the mat of paving material being laid by the width of the mat and the distance that has been paved. Multiplying these three values may calculate a volume of material, which may be multiplied by the known density of the paving material to calculate the weight of paving material that has been laid. Yield, expressed as a weight ($Y_W$), may be calculated by the following formula, wherein T represents the thickness of the mat of paving material being laid, W represents the width of the mat, D represents the distance over which the mat has been laid, and p represents the density of the paving material:

$$Y_W = TWD_\rho$$

In addition, yield may be expressed as a rate at which material is being laid (e.g., tons/hour) and may be calculated using the dimensions of the mat, the density of the paving material, and the speed of the paving machine. Yield, expressed as a rate ($Y_R$), may be calculated by the following formula, wherein T represents the thickness of the mat of paving material being laid, W represents the width of the mat, ρ represents the density of the paving material, and S represents the speed of the paving machine:

$$Y_R = TW\rho S$$

Reference will now be made once again to FIG. 4, which illustrates the placement of height and temperature sensors about the periphery of paving machine 10. The height sensors may measure their own height with respect to a surface (e.g., the ground or newly laid mat) beneath them. Due to their peripheral placement, the measurements taken from each sensor may be compared to measurements taken by a sensor on an opposite side of paving machine 10 to determine information regarding the operation and/or output of paving machine 10. This information may enable controller 50 to automate functions of paving machine 10 in order to improve its accuracy and efficiency.

Controller 50 may determine mat thickness by comparing the measurements taken by front height sensors 32, which may measure to paving surface 26, to those taken by rear height sensors 34, which may measure to mat 24. The mat thickness may be determined by calculating the difference in height measured by front height sensors 32 and rear height sensors 34.

For increased accuracy, the sets of measurements taken by front height sensors 32 and rear height sensors 34 may be taken at the same location or geographic point. That is, for a given set of measurements, the rear height sensor measurement may be delayed for a period of time after the front height sensor measurement, such that the rear height sensor measurement is taken when rear height sensor 34 arrive at the geographic point on paving surface 26 where the front height sensor measurement was taken. The speed of paving machine 10, as monitored by paving machine speed sensor 64, may be used by controller 50 to determine the delay necessary to take the measurements at the same geographic point.

Controller 50 may calculate mat thickness repeatedly as a new mat is laid, thus determining the uniformity in the thickness over a stretch of paved material. In addition, each of front height sensors 32 may be aligned on the paving machine with corresponding rear height sensors 34, as shown by dashed lines 80, thus forming pairs of sensors. By comparing the mat thicknesses measured by each pair of sensors, controller 50 may determine mat thickness at more than one location across a mat of paving material. Controller 50 may also be configured to control the functions of paving machine 10 in response to these thickness calculations. If controller 50 determines that the mat is too thick on one side of the mat, controller 50 may compensate for the error by adjusting one or more settings of components on the side of paving machine 10 that is laying the mat too thickly. For example, controller 50 may lower the tow arm and/or reduce the conveyor speed on only the side with the thicker mat in order to reduce the mat thickness on only that side.

The smoothness of the mat may also be monitored by the disclosed control system. The controller may be configured to determine the smoothness along the mat by recording height measurements from rear height sensors 34 at timed intervals and comparing them to one another. More consistent height measurements indicate a smoother mat. In addition, controller 50 may be configured to determine the smoothness across the mat by comparing height measurements of the rear sensors to one another. For example, controller 50 may simultaneously record height measurements from each rear sensor. Controller 50 may compare the measurements to one another. Again, more consistent measurements are indicative of a smoother mat. Controller 50 may also be configured to control the functions of paving machine 10 in response to these smoothness determinations.

Paving machine 10 may also be equipped with automatic grade control. Automatic grade control may automatically control paving machine 10 to produce a mat with a particular elevation relative to a reference surface. Paving machine 10 may include several right side height sensors 36 and/or left side height sensors 38 configured to measure height from a reference surface laterally spaced from the paving machine. The reference surface may be, for example, paving surface 26, or a curb alongside a roadway being paved by paving machine 10. The reference surface may also be a previously laid mat of pavement next to which paving machine 10 is to abut an additional mat (i.e., the surfaces of the two mats should be at the same elevation).

In operation, height measurements recorded from right side height sensors 36 and/or left side height sensors 38 may be averaged to determine the average elevation of the reference surface. Measurement averages will fluctuate less than a series of measurements made by a single sensor. Thus the measurements may be averaged in order to provide a smoother baseline from which to reference the elevation of the mat.

In addition, each of right side height sensors 36 may be aligned on the paving machine with corresponding left side height sensors 38, as shown by dashed lines 82, to form pairs of sensors. By determining the elevation of reference surfaces on both sides of paving machine 10, controller 50 may control the elevation across the mat. Controller 50 may independently control the height of the lateral ends of screed 20 to create a mat having a cross-slope. That is, screed 20 may be angled to make one side of the mat higher than the other.

In order to monitor pavement temperature, paving machine 10 may also include one or more rear temperature sensors 40 configured to measure a mat temperature behind screed 20. Controller 50 may be configured to determine the uniformity of the mat temperature by comparing the temperatures recorded from the one or more rear temperature sensors 40. Controller 50 may be further configured to automatically initiate adjustments of one or more settings of paving machine 10 in order to maintain a uniform mat temperature. These settings may include conveyor speed, auger speed, and auger height.

It will be apparent to those skilled in the art that various modifications and variations can be made to the disclosed paving machine output monitoring system without departing from the scope of the invention. Other embodiments of the invention will be apparent to those skilled in the art from consideration of the specification and practice of the invention disclosed herein. It is intended that the specification and examples be considered as exemplary only, with a true scope of the invention being indicated by the following claims and their equivalents.

What is claimed is:

1. A paving machine comprising:

a screed configured to lay a mat of paving material;

at least one front sensor mounted on a front portion of the paving machine and configured to measure height from a surface to the front sensor;

at least one rear sensor mounted on the paving machine and configured to measure height from a top surface of the mat to the rear sensor; and a controller configured to determine a thickness of the mat by determining a difference between one or more front height measurements taken by the at least one front sensor and one or more rear height measurements taken by the at least one rear sensor.

2. The paving machine of claim 1, wherein the controller is configured to record height measurements from the at least one front sensor at a first set of points and record height measurements from the at least one rear sensor at a second set of points that correspond to the first set of points.

3. The paving machine of claim 2, wherein corresponding points of the first and second sets of points are co-located.

4. The paving machine of claim 3, further including a speed sensor configured to measure a rate of travel of the paving machine, wherein the controller is configured to determine a time interval for taking the measurements based on output from the speed sensor.

5. The paving machine of claim 1, wherein the paver includes more than one front sensor and more than one rear sensor, each rear sensor being aligned with one of the front sensors forming a sensor pair, wherein the controller is configured to determine a mat thickness measurement for each sensor pair.

6. The paving machine of claim 1, wherein the controller is further configured to:

determine a yield of the paving machine based on the determined mat thickness and a distance traveled by the paving machine.

7. The paving machine of claim 1, wherein the sensors are selected from the group consisting of sonic-based sensors and laser-based sensors.

8. The paving machine of claim 1, wherein the controller is further configured to automatically initiate adjustments to one or more settings of the paving machine based on the determined difference between the one or more front height measurements taken by the at least one front sensor and the one or more rear height measurements taken by the at least one rear sensor.

9. The paving machine of claim 8, wherein the one or more settings are selected from the group consisting of screed height, conveyor speed, auger speed, and auger height.

10. The paving machine of claim 1, wherein the controller is further configured to:

record height measurements incrementally from the at least one rear sensor as the paving machine travels in a forward direction; and determine smoothness of the mat in at least one of a longitudinal direction parallel to the forward direction and a lateral direction perpendicular to the forward direction by comparing recorded height measurements from the at least one rear sensor.

11. The paving machine of claim 10, wherein the controller is further configured to:

determine smoothness of the mat in both the longitudinal direction and the lateral direction.

12. The paving machine of claim 1, further including:

a first set of at least two sensors mounted on a right side of the paving machine and configured to measure height from a reference surface laterally spaced from the paving machine; and a second set of at least two sensors mounted on a left side of the paving machine and configured to measure height from a reference surface laterally spaced from the paving machine;

wherein the controller is further configured to average height measurements from at least one of the first and second sets of at least two sensors and to control the height of the screed based on the average height in order to create a mat with a predetermined elevation relative to the reference surface.

13. The paving machine of claim 12, wherein the controller is further configured to independently control screed height at a right end and a left end of the screed based on output from the first and second set of at least two sensors.

14. The paving machine of claim 1, further including at least one temperature sensor configured to measure a mat temperature, wherein the controller is further configured to automatically initiate adjustments to one or more settings of the paving machine based on an output of the at least one temperature sensor.

15. A method for paving comprising:

laying a mat of paving material with a screed attached to a paving machine;

taking one or more front height measurements from a surface adjacent to a front portion of the paving machine, with at least one front sensor mounted on the front portion of the paving machine;

taking one or more rear height measurements from a top surface of the mat adjacent to a rear portion of the paving machine, with at least one rear sensor mounted on the rear portion of the paving machine; and determining a thickness of the mat of paving material by determining with a controller, at least one difference between the one or more front height measurements and the one or more rear height measurements.

16. The method of claim 15, further including:

recording the one or more front height measurements at a first set of points;

recording the one or more rear height measurements at a second set of points corresponding to the first set of points.

17. The method of claim 16, wherein corresponding points of the first and second sets of points are co-located.

18. The method of claim 15, further including:

determining a series of mat thickness values incrementally along the mat as the paving machine travels in a forward direction;

averaging the mat thickness values; and calculating a yield of the paving machine based on an average mat thickness value.

19. The method of claim 15, further including:

recording height measurements incrementally from the at least one rear sensor as the paving machine travels in a forward direction; and determining a smoothness of the mat in at least one of a longitudinal direction parallel to the forward direction and a lateral direction perpendicular to the forward direction by comparing recorded height measurements from the at least one rear sensor.

20. The method of claim 19, further including:

determining a smoothness of the mat in both the longitudinal direction and the lateral direction.

21. The method of claim 15, further including automatically initiating adjustments to one or more settings of the paving machine based on the at least one determined difference.

22. The method of claim 21, wherein the one or more settings are selected from the group consisting of screed height, conveyor speed, auger speed, and auger height.

23. The method of claim 15, wherein the paving machine includes more than one front sensor and more than one rear sensor, each front sensor being aligned with a corresponding rear sensor to form sensor pairs, and further including the step of determining a mat thickness value from each sensor pair.

24. The method of claim 15, wherein the paving machine further includes:

a first set of sensors including at least two right side sensors mounted on a right side of the paving machine and configured to measure height from a reference surface laterally spaced from the paving machine; and a second set of sensors including at least two left side sensors mounted on the left side of the paving machine and configured to measure height from a reference surface laterally spaced from the paving machine, wherein each right side sensor is aligned on the paving machine with a corresponding left side sensor to form sensor pairs; and further including the steps of recording height measurements from the first and second set of sensors, averaging the recorded height measurements from at least one of the first and second set of sensors, and controlling the height of the screed, based on the average of the height measurements, in order to create a mat with a predetermined elevation relative to the reference surface.

25. The method of claim 15, wherein the paving machine further includes at least one temperature sensor configured to measure mat temperature behind the screed, the method further including determining a mat temperature uniformity value based on output from the at lest one temperature sensor and automatically initiating adjustments to one or more settings of the paving machine in response to the mat temperature uniformity value.

26. A paving machine comprising:

a screed configured to lay a mat of paving material;

means mounted on a front portion of the paving machine for taking one or more front height measurements from a surface adjacent to the front portion of the paving machine;

means mounted on a rear portion of the paving machine for taking one or more rear height measurements adjacent to a rear portion of the paving machine from a top surface of the mat of paving material; and a controller configured to determine a thickness of the mat by determining at least one difference between the one or more front height measurements and the one or more rear height measurements.

27. The paving machine of claim 26, further including:

means for recording the one or more front height measurements at a first set of points; and recording the one or more rear height measurements at a second set of points that correspond to the first set of points, wherein corresponding points of the first and second sets of points are co-located.

28. The paving machine of claim 26, further including:

means for determining a series of mat thickness values incrementally along the mat as the paving machine travels in a forward direction;

means for averaging the mat thickness values; and means for calculating a yield of the paving machine based on an average mat thickness value.

29. The paving machine of claim 26, further including:

means for recording height measurements incrementally from at least one rear sensor as the paving machine travels in a forward direction; and means for determining smoothness of the mat in at least one of a longitudinal direction parallel to the forward direction and a lateral direction perpendicular to the forward direction by comparing recorded height measurements from the at least one rear sensor.

* * * * *